US007687992B2

(12) United States Patent
Contarino et al.

(10) Patent No.: US 7,687,992 B2
(45) Date of Patent: Mar. 30, 2010

(54) GATING LARGE AREA HYBRID PHOTOMULTIPLIER TUBE

(75) Inventors: Vincent Michael Contarino, Lusby, MD (US); Pavlo Molchanov, Lexington Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 469 days.

(21) Appl. No.: 11/801,770

(22) Filed: Apr. 26, 2007

(65) Prior Publication Data

US 2008/0265768 A1 Oct. 30, 2008

(51) Int. Cl.
*H01J 40/00* (2006.01)
*H01J 40/16* (2006.01)

(52) U.S. Cl. ..... 313/537; 313/532; 313/534

(58) Field of Classification Search ..... 313/529, 313/531–537; 250/207, 214
See application file for complete search history.

(56) References Cited

U.S. PATENT DOCUMENTS 5,326,978 A 7/1994 Aebi et al.
5,374,826 A 12/1994 LaRue et al.
5,475,227 A 12/1995 LaRue
5,654,536 A 8/1997 Suyama et al.
5,917,282 A 6/1999 Suyama et al.
6,166,365 A 12/2000 Simonetti et al.
6,297,489 B1 10/2001 Suyama et al.
2004/0155187 A1 * 8/2004 Axelsson ..... 250/336.1

OTHER PUBLICATIONS

M.Suyama,A.Fukasawa,J.Haba,T.Iijima.S.Iwata . . . .Development of Multi-pixel hybrid photo-detector with high quantum efficiency and gain, Nuclear Science Symposium, 2003 IEEE vol. 2.

C.Joram, Large Area Hybrid Phtodiodes, Nuclear Physics B—Proceedings Supplements vol. 78, Issues 1-3, Aug. 1999, pp. 407-441.

* cited by examiner

*Primary Examiner*—Bumsuk Won
(74) *Attorney, Agent, or Firm*—Mark O. Glut

(57) ABSTRACT

A gating large area hybrid photomultiplier tube that includes an envelope, a photocathode for emitting electrons in correspondence with incident light entering the envelope, a collecting anode having a semiconductor device which has an electron incident surface for receiving photoelectrons emitted from the photocathode, a gating grid for gating the photoelectrons emitted from the photocathode, an electron optical system for focusing and directing the photoelectrons generated by the photocathode toward the electron incident surface, and an ion target for collecting positive ions from the photoelectrons. The envelope has a first opening and a second opening; the photocathode is disposed at the first opening, while the collecting anode is disposed at the second opening of the envelope.

16 Claims, 2 Drawing Sheets

GATING LARGE AREA HYBRID PHOTOMULTIPLIER TUBE

STATEMENT OF GOVERNMENT INTEREST

The invention described herein may be manufactured and used by or for the Government of the United States of America for governmental purposes without payment of any royalties thereon or therefor.

BACKGROUND

The present invention relates to a gating hybrid photomultiplier tube used for the detection of weak signals, electrons or ions. More specifically, but without limitation, the present invention relates to a gating large area hybrid photomultiplier tube for detection of reflected signals from target weak light signals, more particularly, in laser underwater systems, airborne systems, astronomic systems, geophysics remote sensing systems, distance measurement and imaging systems.

Conventional photodetectors include at least one photocathode to emit photoelectrons in correspondence with incident light, a semiconductor device having an electron incident surface for receiving the photoelectrons from the photocathode, the electron incident surface being arranged so as to face the photocathode, and a confining mechanism or focusing electrodes arranged between the photocathode and the electron incident surface to confine orbits of the photoelectrons from the photocathode. Typical photodetectors known in the art can be damaged by positive ions, tube electrodes may be short circuited, and/or have operational instability.

Thus, there is a need in the art to provide a large area hybrid photomultiplier tube without the limitations inherent in present methods.

SUMMARY

It is a feature of the invention to provide a gating large area hybrid photomultiplier tube that includes an envelope, a photocathode for emitting electrons in correspondence with incident light entering the envelope, a collecting anode having a semiconductor device which has an electron incident surface for receiving photoelectrons emitted from the photocathode, a gating grid for gating the photoelectrons emitted from the photocathode, an electron optical system for focusing and directing the photoelectrons generated by the photocathode toward the electron incident surface, and an ion target for collecting positive ions from the photoelectrons. The envelope has a first opening and a second opening; the photocathode is disposed at the first opening, while the collecting anode is disposed at the second opening of the envelope. The photocathode and the collecting anode create a vacuum in the envelope. The electron incident surface faces the photocathode, the gating grid is disposed within the envelope, the electron optical system is disposed between the photocathode and the semiconductor device, and the ion target is disposed at or about the center of the gating grid.

It is a feature of the invention to provide a gating large area hybrid photomultiplier tube that is operationally stable and provides better time characteristics in comparison with conventional photomultipliers.

It is a feature of the invention to provide a gating large area hybrid photomultiplier tube that does not create positive ions inside the photomultiplier tube, thus preventing positive ion damage to the photocathode.

It is a feature of the invention to provide a large area hybrid photomultiplier tube that works with short light pulses.

DRAWINGS

These and other features, aspects and advantages of the present invention will become better understood with reference to the following description and appended claims, and accompanying drawings wherein:

DESCRIPTION

Figure 1:
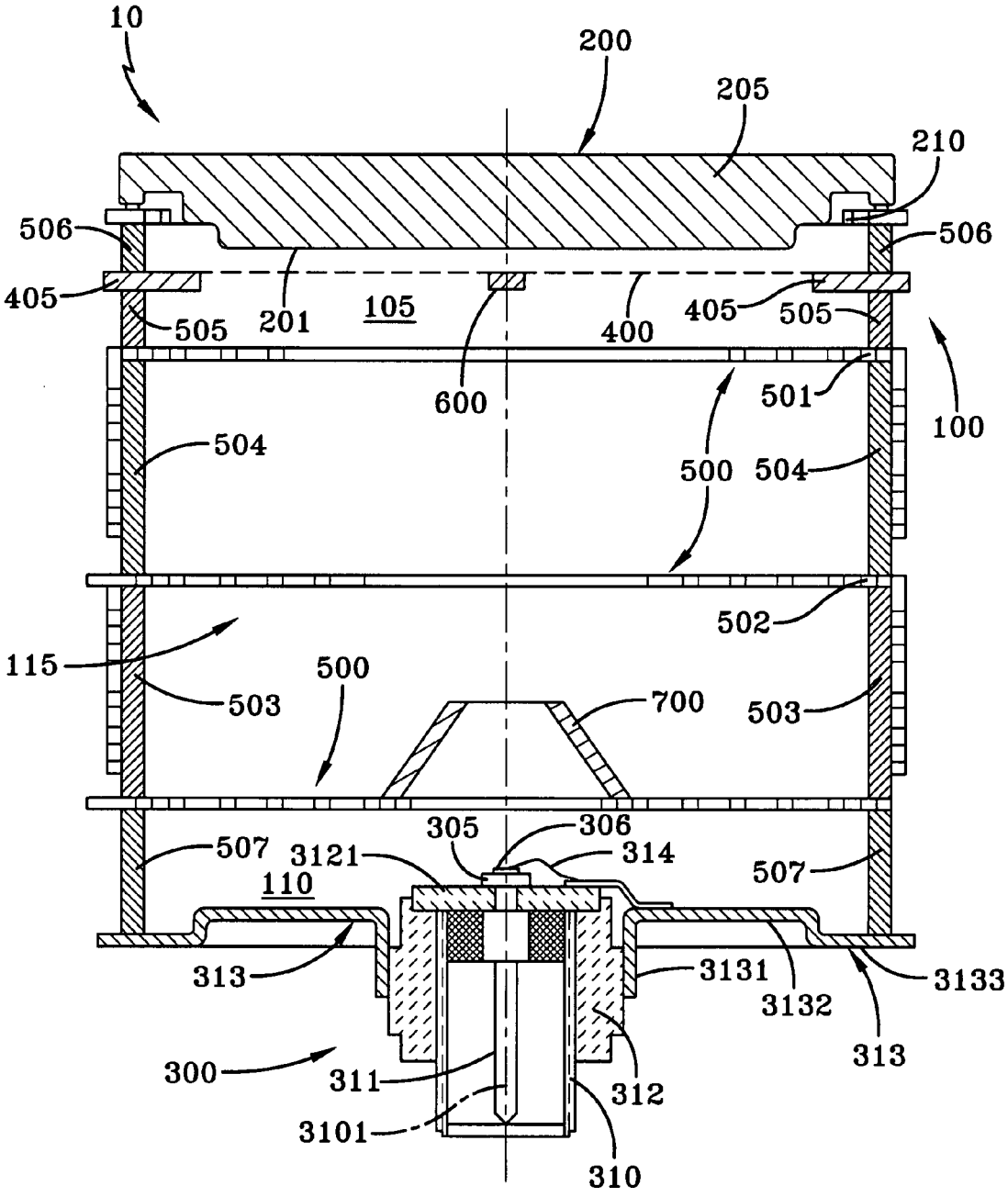
FIG. 1 is a side internal view of an embodiment of the gating large area hybrid photomultiplier tube.
Figure 2:
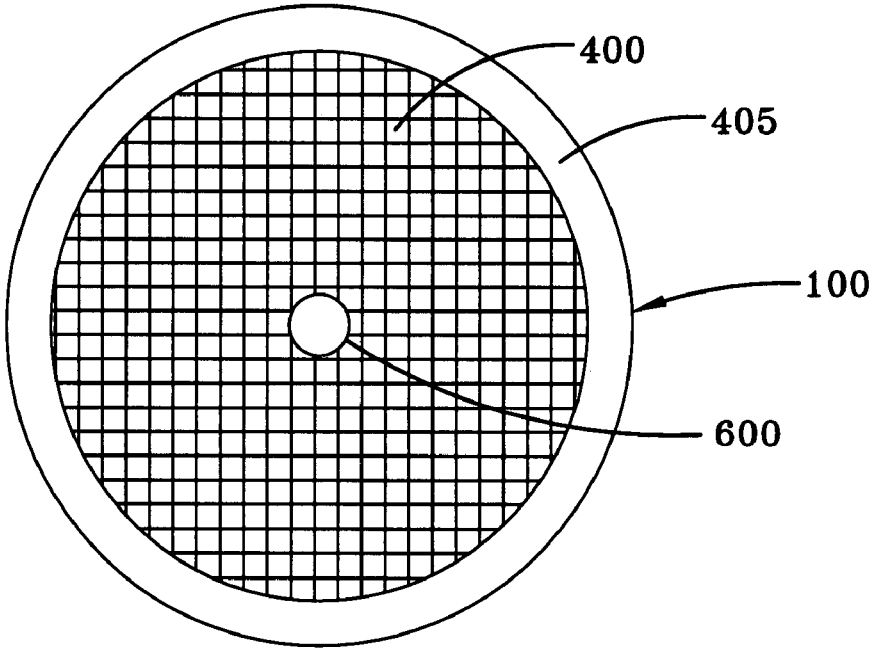
FIG. 2 is a cross sectional view of an embodiment of the gating large area hybrid photomultiplier tube.
Figure 3:
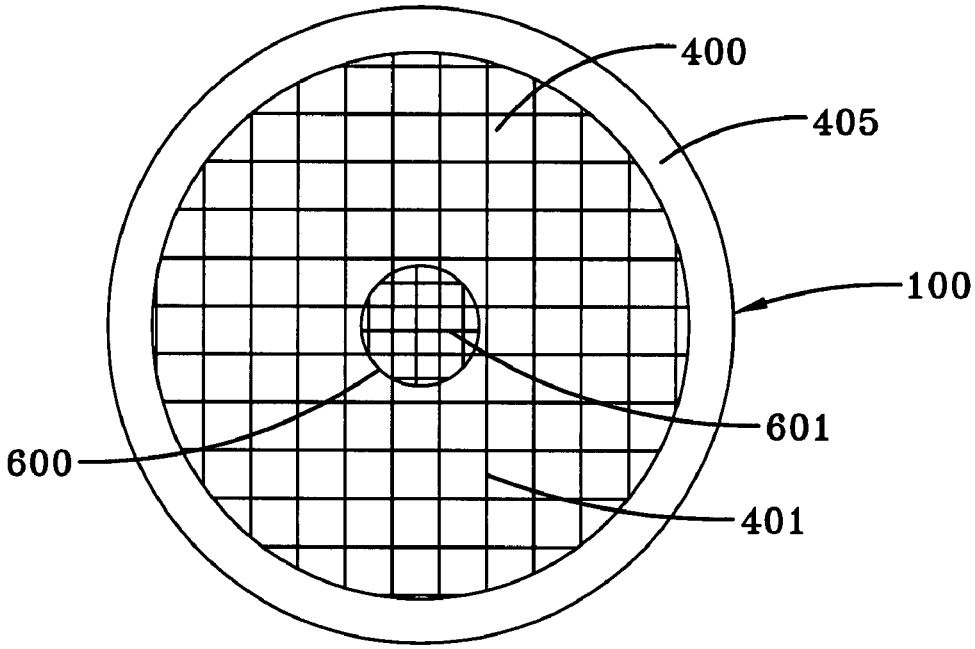
FIG. 3 is a cross sectional view of another embodiment of the gating large area hybrid photomultiplier tube.

The preferred embodiment of the present invention is illustrated by way of example below and in FIGS. 1-3. As shown in FIG. 1, the photomultiplier tube 10 includes an envelope 100, a photocathode 200 for emitting photoelectrons in correspondence with incident light entering the envelope 100, a collecting anode 300 having a semiconductor device 305 with an electron incident surface 306 for receiving photoelectrons emitted from the photocathode 200, a gating grid 400 for gating the photoelectrons emitted from the photocathode 200, an electron optical system 500 for focusing and directing the photoelectrons generated by the photocathode 200 toward the electron incident surface 306, and an ion target 600 for collecting positive ions from the photoelectrons. The envelope 100 has a first opening 105 and a second opening 110. The photocathode 200 is disposed at the first opening 105, and the collecting anode 300 is disposed at the second opening 110 of the envelope 100 such the photocathode 200 and the collecting anode 300 create a vacuum in the envelope 100 (specifically in the interior 115 of the envelope 100). The electron incident surface 306 faces the photocathode 200. The gating grid 400 is disposed within the envelope 100, the electron optical system 500 is disposed between the photocathode 200 and the semiconductor device 305, and the ion target 600 is disposed at or about the center of the gating grid 400.

In the description of the present invention, the invention will be discussed in a laser radar system environment; however, this invention can be utilized for any type of need that requires use of a photomultiplier tube or photodetector.

The envelope 100 (or container) could be cylinder shaped or any other shape practicable. As shown in FIG. 1, the first opening 105 and the second opening 110 may be disposed on opposite axial ends of the envelope 100.

A photocathode 200 may be defined, but without limitation, as an electrode used for obtaining photoelectric emission when irradiated, or a conductor through which a current enters or leaves an electric or electronic device. The photocathode 200 may include group II-IV semiconductor material, such as, but without limitation, gallium arsenide, gallium arsenide phosphide, indium phosphide, indium gallium arsenide or alkali-antimonides (alkali-antimonides can include, but without limitations, $Na_2$, KSbCs, $Cs_3Sb$, or $Na_2KSb$), The photocathode 200 may include a photosensitive layer 205 and a photocathode electrode portion 210. The photocathode electrode portion 210 may be disposed around the outer edge of the photosensitive layer 205.

In addition to the semiconductor device 305, the collecting anode 300 may also include a coaxial feedthrough 310 with a step-tapered central transmission line section 311 disposed through the axial center 3101 of the coaxial feedthrough 310.

The coaxial feedthrough 310 may be in electronic communication with the semiconductor device 305. The coaxial feedthrough 310 may be attached to a cable (not shown), which can transmit any type of electrical signal. The signal may be transmitted to processor, computer or any type of acceptor of signals. The central transmission line section 311 may have a circular cross section. The collecting anode 300 may also include a ceramic isolator 312 and an external conductor 313. The ceramic isolator 312 may be in the shape of an axially extended annulus with a lid (or closed end top portion 3121) and partially envelop or slip over the coaxial feedthrough 310. The external conductor 313 may be ring or washer like in shape and the inner diameter of the external conductor 313 may be in communication with the outer diameter of the ceramic isolator 312. In the preferred embodiment, the external conductor 313 includes a flange portion 3131, a main portion 3132, and a lip portion 3133. The flange portion 3131 may be disposed at or near the outer diameter of the external conductor 313 and substantially perpendicular to the main portion 3132. The main portion 3132 extends away from the flange portion 3131 toward the lip portion 3133. The flange portion 3131 may in be communication with the ceramic isolator 312. The semiconductor device 305 may be mounted on the ceramic isolator 312 (preferably on the closed end top portion 3121 of the ceramic isolator 312). In the preferred embodiment, the semiconductor device 305 is a solid state photodiode. The preferred photodiode is a Schottky diode or p-i-n diode. The electron incident surface 306 may electrically communicate with the external conductor 313 (particularly the main portion 3132 of the external conductor 313) via a thin conductor 314.

The gating grid 400 may be a metal grid arranged close to the inner surface 201 of the photocathode 200. The inner surface 201 of the photocathode 200 is the edge or surface that is facing into the interior 115 or inside of the envelope 100. The gating grid 400 may correspond to the inner diameter of the envelope 100 or be sized such that an entire cross sectional area of the envelope 100 is covered by the gating grid 400. The gating grid 400 may be connected to an external power supply through a related conductor 405 or conductors. The related conductor(s) 405 may be ring like and disposed on the outer edge or outer diameter of the gating grid 400. In another embodiment of the invention, the gating grid 400 may be deposited on the inner surface 201 of the photocathode 200 and isolated from the photocathode 200 by a dielectric layer.

The electron optical system 500 may include focusing electrodes formed as cylindrical rings 501, 502 mounted between isolation rings 503, 504, 505. The electron optical system 500 may be connected to an external power supply. The cylindrical rings 501, 502 focus and direct the photoelectrons generated by the photocathode 200 onto the collecting anode 300, specifically the electron incident surface 306. The photomultiplier 10 may also include a isolation ring 506 disposed between the photocathode 200 and the gating grid 400.

The ion target 600 may be disposed at about the center of the gating grid 400. In one of the embodiments of the invention, the ion target 600 is a solid metal plate welded to the gating grid 400. As shown in FIG. 2, the envelope 100, the gating grid 400, and the ion target 600 may have a circular cross section and may be axially aligned. The gating grid 400 may be a metal grid with gating grid cells 401 that is welded inside the related conductor 405 (which may be a metal ring conductor). In the preferred embodiment of the invention, the gating grid cells 401 are square shaped. In another embodiment of the invention, as shown in FIG. 3, the ion target 600 may be a metal grid with ion target cells 601. In the preferred embodiment of the invention, the ion target cells 601 are square shaped, and the size of the individual squares or ion target cells 601 of the ion target 600 is smaller than the size of the individual squares or gating grid cells 401 of the gating grid 400. In the preferred embodiment of the invention, the size of the ion target conductive area is the size of about 1% to about 5% of the size of the photocathode 200 surface area.

The photomultiplier tube 10 may also include an ion trap electrode 700. The ion trap electrode 700 may be disposed between one of the cylindrical rings 502 of the electron optical system 500 and the collecting anode 300. The ion trap electrode 700 may be formed by pressing a stainless steel plate or may be integrated with a welded flange portion and have a cone, a cylinder shape, or any other shape practicable. There may be another isolation ring 507 disposed between the ion trap electrode 700 and the collecting anode 300.

In operation, an accelerate voltage on the order of about 8-10 kV is typically applied between the photocathode 200 and the external conductor 313. The bias voltage on the order of several volts is applied to the semiconductor device 305 between the external conductor 313 and the coaxial feedthrough 310. Electrons are accelerated by the applied field and bombard the electron incident surface 306 of the semiconductor device 305. As a result of bombarding the electron incident surface 306 (or photodiode) by electrons (which are accelerated and focused on the electron incident surface 306), the electrons multiply and the photodiode's bias current provides an increased output signal of the hybrid photomultiplier tube 10.

The cylindrical rings 501, 502 are applied with a predetermined voltage from the external voltage source (not shown). Typically voltage applied to one of the cylindrical rings 501 consists about 80-98% and voltage to another cylindrical ring 502 consists about 60-90% from voltage applied between the photocathode 200 and the semiconductor device 305 (ground). The ion trap electrode 700 is applied with a predetermined voltage, which is negative relative to the semiconductor device voltage, typically from about −50 to about −350 volts.

Negative relative semiconductor device voltage applied to the ion trap electrode 700 creates a braking electric field for electrons bombarding the ion trap electrode 700 and typically the energy of bombarding electrons is not enough for ionization from the ion trap electrode surface. Therefore negative voltage applied to the ion trap electrode 700 prevents generation of positive ions on the ion trap electrode surface and provides a long time of operating and improves noise factor. Same time negative voltage applied to the ion trap electrode 700 and voltage applied to the electron optical system 500 are creating an electric lens for focusing positive ions, generated from the collecting anode 300 to the ion target 600. The ion target 600 and the gating grid 600 are set at the same negative potential relative to the semiconductor device 305. Positive ions, generated on the electron incident surface 306 of semiconductor device 305 will pass by the electron optical system 500 and are collected by the ion target 600. Therefore, negative potential applied to the ion target 600 pulls positive ions and prevents photocathode bombardment and damage by positive ions generated on the electron incident surface 306 of semiconductor device 305 and provides a long time of operating.

Negative voltage, applied to the gating grid 600 pulls positive ions and prevents photocathode damage by positive ions generated inside the photomultiplier volume by residual gases ionization. It prevents damage to the photocathode 200 and provides a long time of operating and improves noise factor too.

The gating grid 600 disposed close to the inner surface 201 of the photocathode 200 provides much smaller time of gate operation (a few ns for said regimes) and high repetition rate and allows work with short-time light pulses. Therefore, the gating grid 600 allows using the photocathode 200 for a very short time of useful input signal receiving and prolonging time of operation. The gating grid 600 is a defense of the photocathode 200 from water surface reflected laser and sun beams.

When introducing elements of the present invention or the preferred embodiment(s) thereof, the articles "a", "an", "the" and "said" are intended to mean there are one or more of the elements. The terms "comprising," "including," and "having" are intended to be inclusive and mean that there may be additional elements other than the listed elements.

Although the present invention has been described in considerable detail with reference to a certain preferred embodiment thereof, other embodiments are possible. Therefore, the spirit and scope of the appended claims should not be limited to the description of the preferred embodiment(s) contained herein.

What is claimed is:

1. A photomultiplier tube, comprising:

an envelope, the envelope having a first opening and a second opening;

a photocathode for emitting electrons in correspondence with incident light entering the envelope, the photocathode disposed at the first opening;

a collecting anode having a semiconductor device, the semiconductor device having an electron incident surface for receiving photoelectrons emitted from the photocathode, the collecting anode disposed at the second opening of the envelope, the photocathode and the collecting anode creating a vacuum in the envelope, the electron incident surface facing the photocathode;

a gating grid for gating the photoelectrons emitted from the photocathode, the gating grid disposed within the envelope;

an electron optical system for focusing and directing the photoelectrons generated by the photocathode toward the electron incident surface, the electron optical system disposed between the photocathode and the semiconductor device, the electron optical system comprising focusing electrodes formed as cylindrical rings mounted between isolation rings; and an ion target for collecting positive ions from the photoelectrons, the ion target disposed at or about the center of the gating grid.

2. The photomultiplier tube of claim 1, wherein the collecting anode includes a coaxial feedthrough with a central transmission line section disposed though the coaxial feedthrough, the coaxial feedthrough communicating with the semiconductor device.

3. The photomultiplier tube of claim 2, wherein the central transmission line section is step-tapered.

4. The photomultiplier tube of claim 3, wherein the central transmission line section has a circular cross section.

5. The photomultiplier tube of claim 1. wherein the collecting anode includes a ceramic isolator and an external conductor, the ceramic isolator disposed on the outside of the collecting anode, and the semiconductor disposed on the ceramic isolator, the external conductor communicating with the ceramic isolator, the coaxial feedthrough extending through the ceramic isolator.

6. The photomultiplier tube of claim 1, wherein the semiconductor device is a solid state photodiode.

7. The photomultiplier tube of claim 6, wherein the photodiode is selected from a Schottky diode and a p-i-n diode.

8. The photomultiplier tube of claim 7, wherein the gating grid is a metal grid disposed in the envelope near the photocathode.

9. A photomultiplier tube, comprising:

a cylindrical envelope, the envelope having a first opening and a second opening;

a photocathode for emitting electrons in correspondence with incident light entering the envelope, the photocathode disposed at the first opening;

a collecting anode having a solid state photodiode, the photodiode having an electron incident surface for receiving photoelectrons emitted from the photocathode, the collecting anode disposed at the second opening of the envelope, the photocathode and the collecting anode creating a vacuum in the envelope, the electron incident surface facing the photocathode;

a gating grid for gating the photoelectrons emitted from the photocathode, the gating grid disposed within the envelope;

an electron optical system for focusing and directing the photoelectrons generated by the photocathode toward the electron incident surface, the electron optical system disposed between the photocathode and the photodiode, the electron optical system comprising focusing electrodes formed as cylindrical rings mounted between isolation rings; and an ion target for collecting positive ions from the photoelectrons, the ion target disposed at or about the center of the gating grid.

10. The photomultiplier tube of claim 9, wherein the first opening and the second opening are disposed on opposite axial ends of the envelope.

11. The photomultiplier tube of claim 10, wherein the ion target is a metal grid with ion target cells, the ion target cells are in the shape of squares.

12. The photomultiplier tube of claim 11, wherein the gating grid includes gating grid cells.

13. The photomultiplier tube of claim 12, wherein the gating grid cells are in the shape of squares.

14. The photomultiplier tube of claim 13, wherein the ion target cells are smaller than the gating grid cells.

15. The photomultiplier tube of claim 12, wherein the size of the ion target conductive area is the size of about 1% to about 5% of the size of the photocathode surface area.

16. The photomultiplier tube of claim 9, wherein the photomultiplier tube further includes an ion trap electrode, the ion trap electrode disposed within the envelope.

* * * * *